US010991519B2

(12) United States Patent
Yan et al.

(10) Patent No.: US 10,991,519 B2
(45) Date of Patent: Apr. 27, 2021

(54) FLEXIBLE CONDUCTOR FOR DISCONNECTOR AND THE DISCONNECTOR THEREOF

(71) Applicant: ABB Power Grids Switzerland AG, Baden (CH)

(72) Inventors: JiaQuan Yan, Guangdong (CN); ShengQiang Li, Beijing (CN); BingLe Li, Beijing (CN); DeLong Wang, Xiamen (CN); Xuan Liu, Beijing (CN)

(73) Assignee: ABB Power Grids Switzerland AG, Baden (CH)

( * ) Notice: Subject to any disclaimer, the term of this patent is extended or adjusted under 35 U.S.C. 154(b) by 0 days.

(21) Appl. No.: 17/046,673

(22) PCT Filed: Apr. 11, 2018

(86) PCT No.: PCT/CN2018/082621
§ 371 (c)(1),
(2) Date: Oct. 9, 2020

(87) PCT Pub. No.: WO2019/196026
PCT Pub. Date: Oct. 17, 2019

(65) Prior Publication Data
US 2021/0050161 A1 Feb. 18, 2021

(51) Int. Cl.
*H01H 1/42* (2006.01)
*H01H 31/28* (2006.01)

(52) U.S. Cl.
CPC ..... *H01H 1/42* (2013.01); *H01H 31/28* (2013.01)

(58) Field of Classification Search
CPC ..... H01H 1/64; H01H 3/46; H01H 31/36; H01H 1/42; H01H 31/28
(Continued)

(56) References Cited

U.S. PATENT DOCUMENTS 1,965,272 A * 7/1934 Wilkins ..... H01H 31/28 200/48 R
2,047,083 A * 7/1936 Sandt ..... H01H 31/28 200/48 P

FOREIGN PATENT DOCUMENTS

CN 102543549 A 7/2012
JP 2002142317 A 5/2002
JP 2004071170 A 3/2004

OTHER PUBLICATIONS

International Search Report and Written Opinion of the International Searching Authority, PCT/CN2018/082621, dated Jan. 15, 2019, 7 pages.

* cited by examiner

*Primary Examiner* — Edwin A. Leon
*Assistant Examiner* — Iman Malakooti
(74) *Attorney, Agent, or Firm* — Sage Patent Group

(57) ABSTRACT

Embodiments of the present disclosure provide a flexible conductor for connecting a main blade and a base of a disconnector. The flexible conductor includes a first portion and a second portion, the first portion is fixed to the base and adapted to bend in a first plane in response to a rotation of the main blade about a first axis; and the second portion is connected to the first portion and fixed to the main blade, the second portion adapted to bend in a second plane substantially perpendicular to the first plane in response to twisting of the main blade about a second axis; wherein the flexible conductor is operable to maintain an electrical connection between the main blade and the base when the main blade rotates and twists with respect to the base to open or close the disconnector.

14 Claims, 7 Drawing Sheets

(58) Field of Classification Search
USPC .... 200/48 KB, 50 C, 282, 162, 164 R, 48 A,
200/554 X, 254, 48 R
See application file for complete search history.

FLEXIBLE CONDUCTOR FOR DISCONNECTOR AND THE DISCONNECTOR THEREOF

CROSS REFERENCE TO RELATED APPLICATIONS

This application is a 35 U.S.C. § 371 national stage application of PCT International Application No. PCT/CN2018/082621 filed on Apr. 11, 2018, the disclosure and content of which is incorporated by reference herein in its entirety.

FIELD

Embodiments of the present disclosure generally relate to a disconnector, and more specifically, to a flexible conductor for connecting a main blade and a base of a disconnector.

BACKGROUND

A high-voltage disconnector is an important switch electrical appliance in the power system and substation electrical system, and it usually needs to be used together with a high-voltage circuit breaker. The main function of the high-voltage disconnector is to ensure that an electrical circuit is completely de-energized for service or maintenance and to act as isolation voltages. Unlike load switches and circuit breakers, disconnectors lack a mechanism for suppression of electric arcs. Thus, they are off-load devices, intended to be opened only after current has been interrupted by some other control device. In some cases, they can also be used to separate and combine small currents in the lines, such as the charging current for bushings, busbars, connectors and short cables, the capacitive current of the switch-displacer capacitors, the circulating current when the double busbars are switched, and the excitation current of the voltage transformers, etc.

The circuit is normally switched on or off by relative movement between a main blade and a base of the disconnector. Different disconnectors have different connection modes between the main blade and the base. In the disconnectors with the main blade having the turning and twisting functions, there are two common ways to connect the main blade and the base. In one known solution, extra moveable and static contacts are arranged on the main blade and the base respectively. The extra moveable and static contacts are made of copper with silver plating on the surface thereof, resulting in a high cost. Furthermore, during the movement of the main blade, the moveable and static contacts increase friction between the main blade and the base, and thus greater power is needed to rotate or twist the main blade than the one without the extra moveable and static contacts. Furthermore, an extra space is needed on the base to arrange the extra static contact, which causes the length of the base to be longer, thereby increasing the cost. Furthermore, the extra static and moveable contacts double the risk of heat dissipation.

In other known solutions, a copper braid twist is used. Although the main blade can be rotated or twisted in this way, the copper braid twist is relatively easy to be broken. Furthermore, the use of a large amount of copper increases cost.

SUMMARY

Embodiments of the present disclosure provide a solution for providing a flexible conductor for connecting a main blade and a base of a disconnector.

In a first aspect, a flexible conductor for connecting a main blade and a base of a disconnector is provided. The flexible conductor comprises a first portion and a second portion, the first portion is fixed to the base and adapted to bend in a first plane in response to a rotation of the main blade about a first axis; and the second portion is connected to the first portion and fixed to the main blade, the second portion adapted to bend in a second plane substantially perpendicular to the first plane in response to twisting of the main blade about a second axis; wherein the flexible conductor is operable to maintain an electrical connection between the main blade and the base when the main blade rotates and twists with respect to the base to open or close the disconnector.

In some embodiments, at least one of the first and second portions comprises multiple layers of metal sheets.

In some embodiments, the first and second portions are interchangeable.

In some embodiments, a sectional area of the multiple layers of metal sheets is at least greater than an area required by an Rated short-time withstand current of the disconnector.

In some embodiments, the multiple layers of metal sheets are laminated at two ends of the flexible conductor.

In some embodiments, the metal sheets are made of copper or aluminum.

In some embodiments, each of the metal sheets is coated with silver.

In some embodiments, the first and second portions are integrally formed.

In some embodiments, the flexible conductor is formed by deforming a part between the first and second portions.

In some embodiments, the first and second portions are connected to each other by at least one fastener or by welding.

In some embodiments, the at least one fastener comprises mounting surfaces perpendicular to each other.

In some embodiments, at least one of the first and second portions is substantially C-shaped or U-shaped.

In some embodiments, sections of C-shaped or U-shaped structures of the first and second portions are substantially perpendicular to each other.

In second aspect, a disconnector comprising a main blade and a base connected to each other using the above mentioned flexible conductor.

It is to be understood that the Summary is not intended to identify key or essential features of embodiments of the present disclosure, nor is it intended to be used to limit the scope of the present disclosure. Other features of the present disclosure will become easily comprehensible through the description below.

BRIEF DESCRIPTION OF THE DRAWINGS

The above and other objectives, features and advantages of the present disclosure will become more apparent through more detailed depiction of example embodiments of the present disclosure in conjunction with the accompanying drawings, wherein in the example embodiments of the present disclosure, same reference numerals usually represent same components.

Throughout the drawings, the same or similar reference symbols are used to indicate the same or similar elements.

DETAILED DESCRIPTION

The present disclosure will now be discussed with reference to several example embodiments. It is to be understood these embodiments are discussed only for the purpose of enabling those skilled persons in the art to better understand and thus implement the present disclosure, rather than suggesting any limitations on the scope of the subject matter.

As used herein, the term "comprises" and its variants are to be read as open terms that mean "comprises, but is not limited to." The term "based on" is to be read as "based at least in part on." The term "one embodiment" and "an embodiment" are to be read as "at least one embodiment." The term "another embodiment" is to be read as "at least one other embodiment." The terms "first," "second," and the like may refer to different or same objects. Other definitions, explicit and implicit, may be comprised below. A definition of a term is consistent throughout the description unless the context clearly indicates otherwise.

Figure 1A:
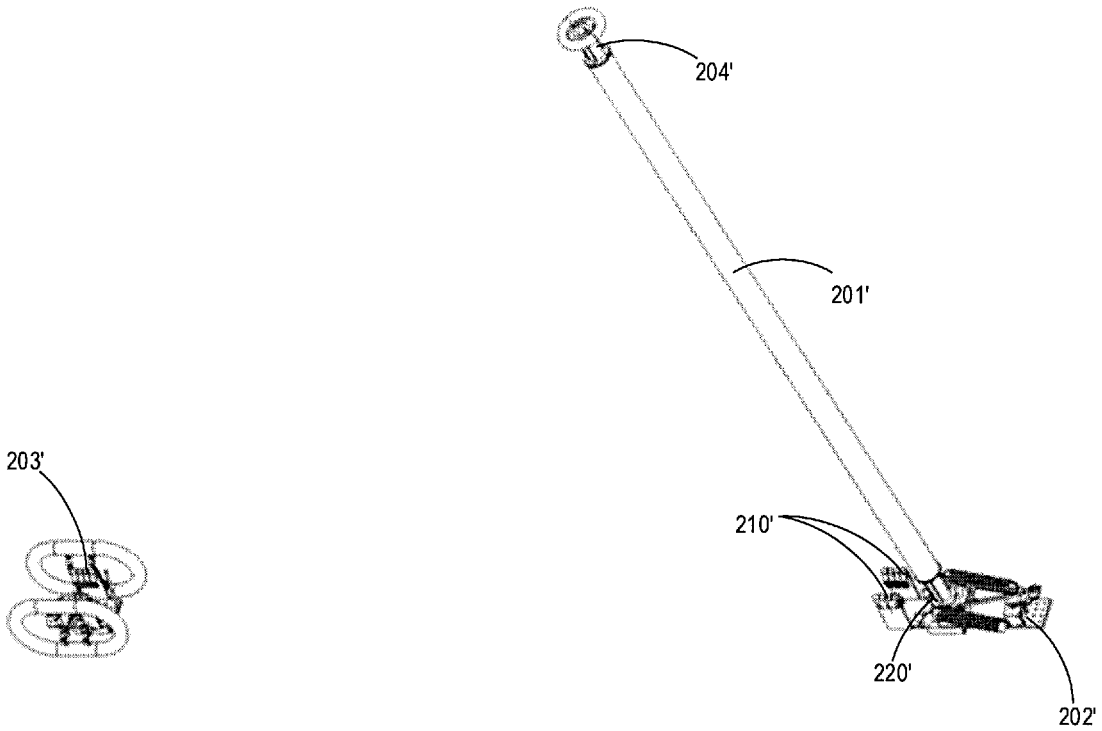
FIGS. 1A and 1B show schematic diagrams of disconnection and connection of a conventional disconnector using copper sheets as connection means between the main blade and the base.
Figure 1B:
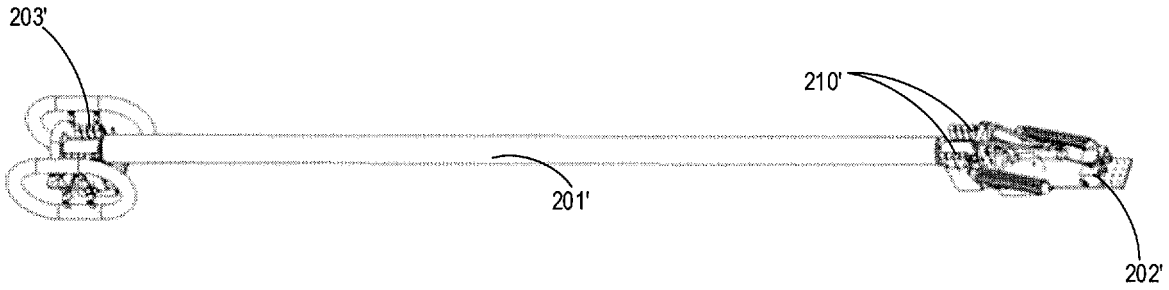

FIGS. 1A and 1B show schematic diagrams of disconnection and connection of a conventional disconnector using copper sheets 210' as connection means between a main blade 201' and a base 202'. As shown, the disconnector comprises static and moveable contacts 203', 204' as well as extra static and moveable contacts 210', 220' which are used to connect the main blade 201' and the base 202'.

The moveable and static contacts 210', 220' are made of copper with silver plating on the surface thereof, thereby resulting in high cost. In addition, during the movement of the main blade 201', there will be friction between the main blade 201' and the static contact 210' which requires greater power to rotate or twist the main blade 201' than the one without the extra static and moveable contacts 210', 220'. Furthermore, an extra space is needed on the base 202' to arrange the extra static contact 220', which causes the length of the base 202' to be longer, thereby increasing the cost. Additionally, the extra static and moveable contacts 210', 220' double the risk of heat dissipation.

In other known solutions, a copper braid twist is used as connection means between the main blade 201' and the base 202'. Although the main blade can be turned and twisted in this way, the copper braid twist is relatively easy to be broken. Furthermore, the use of a large amount of copper increases cost.

In order to maintain the electrical connection between the main blade and the base of the circuit breaker during rotation and twisting in a cost-effective and stable manner, embodiments of the present disclosure provide a solution for providing a flexible conductor for connecting a main blade and a base of a disconnector. Now some example embodiments will be described with reference to FIGS. 2-6D.

Figure 2:
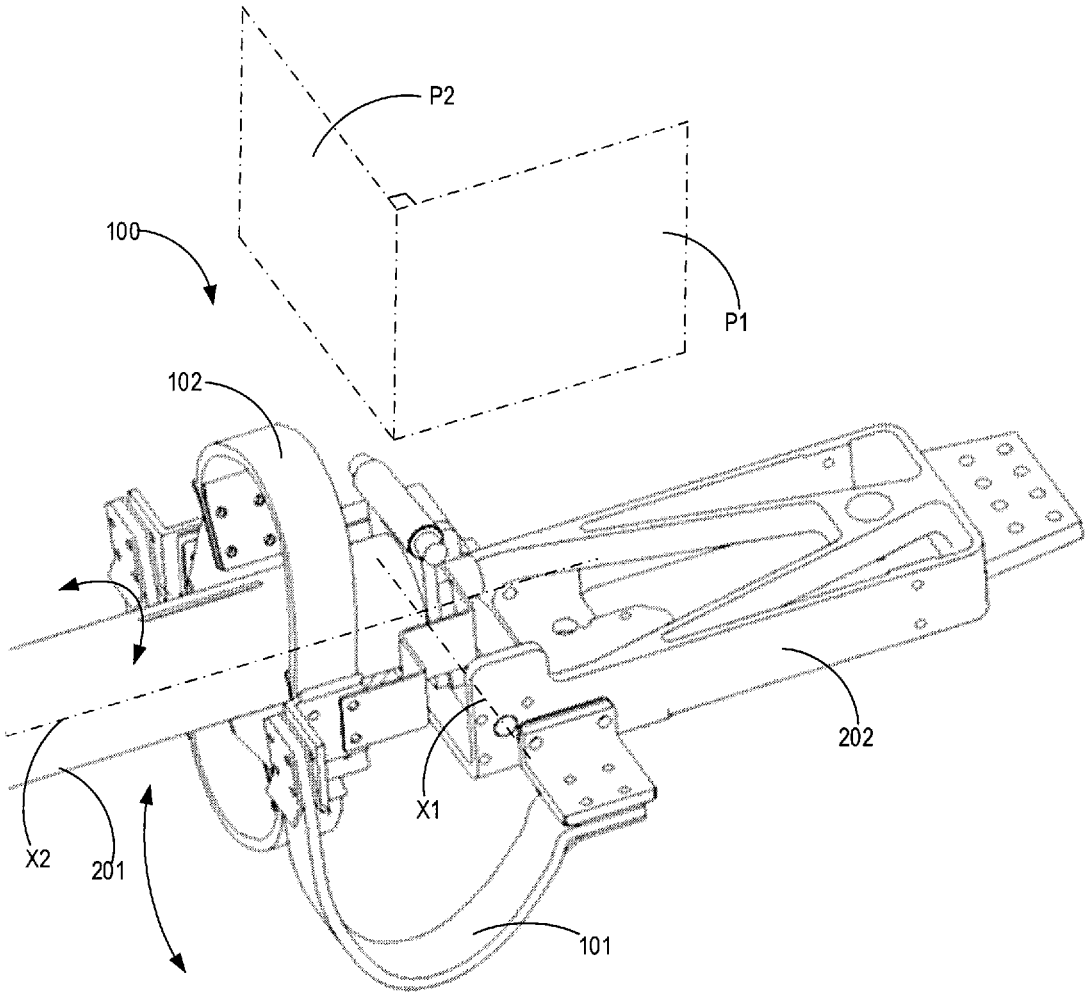
FIG. 2 shows a partial enlarged view of a main blade and a base with a flexible conductor according to embodiments of the present disclosure.
Figure 3:
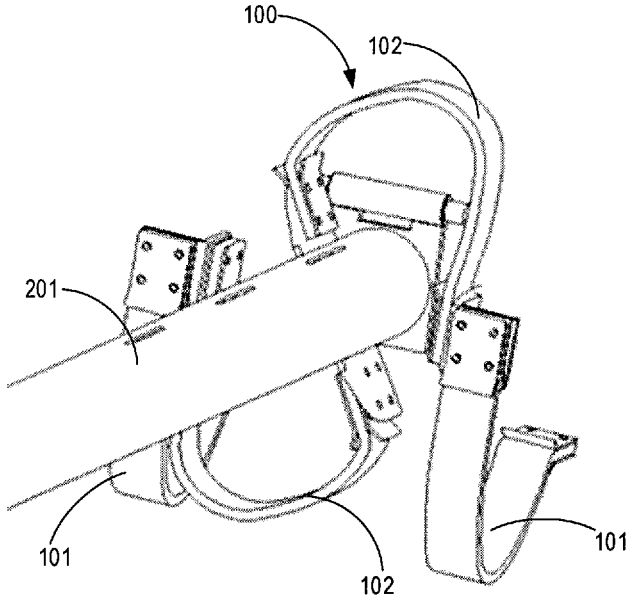
FIG. 3 shows a perspective view of the flexible conductor according to embodiments of the present disclosure attached to the main blade.
Figure 4A:
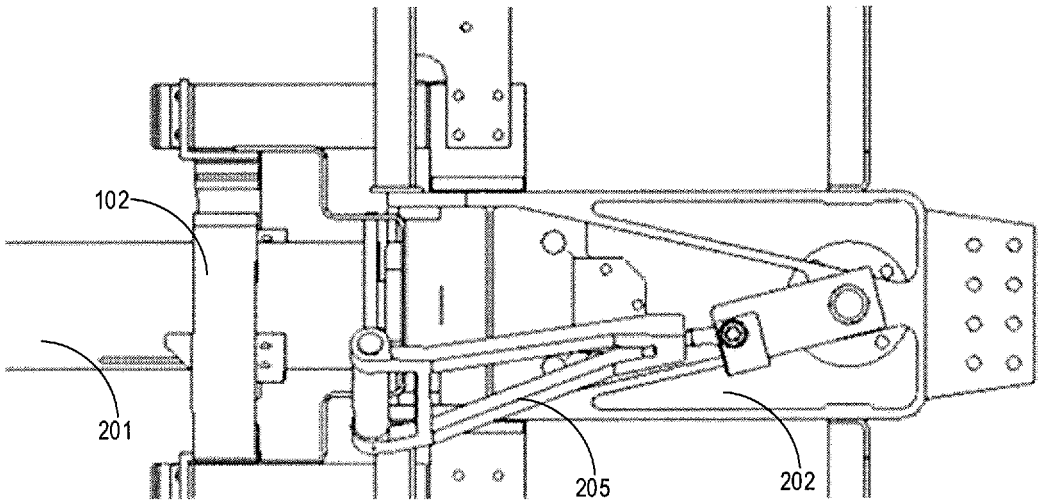
FIGS. 4A-4C show a schematic diagram of the movement of the main blade relative to the base.
Figure 4B:
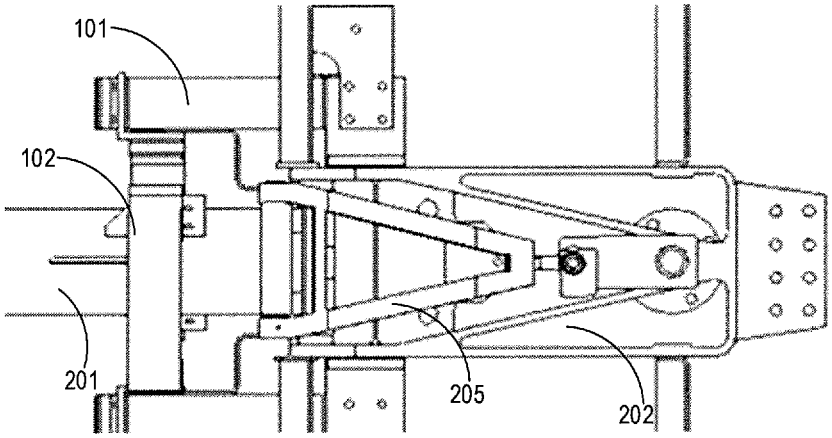
Figure 4C:
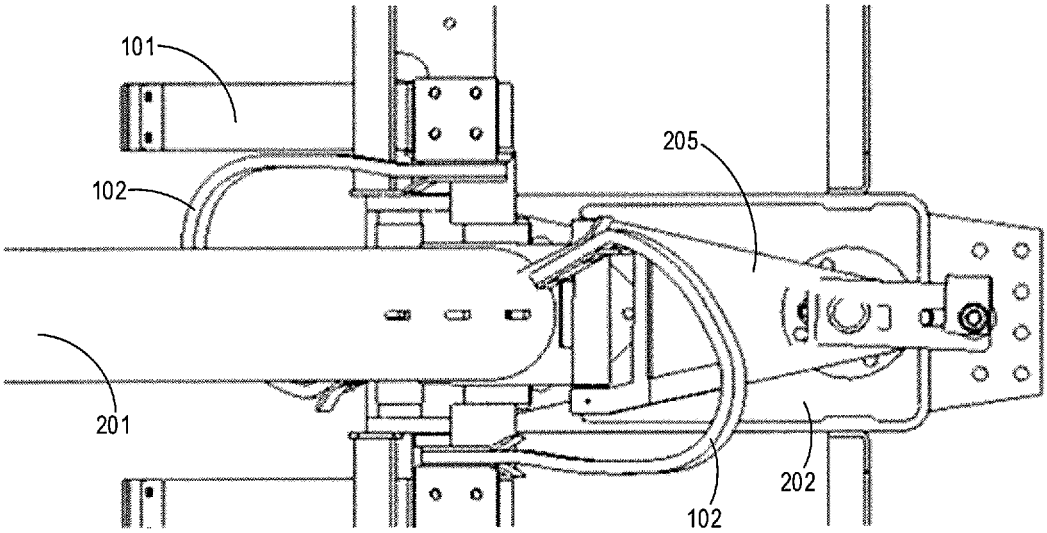
Figure 5A:
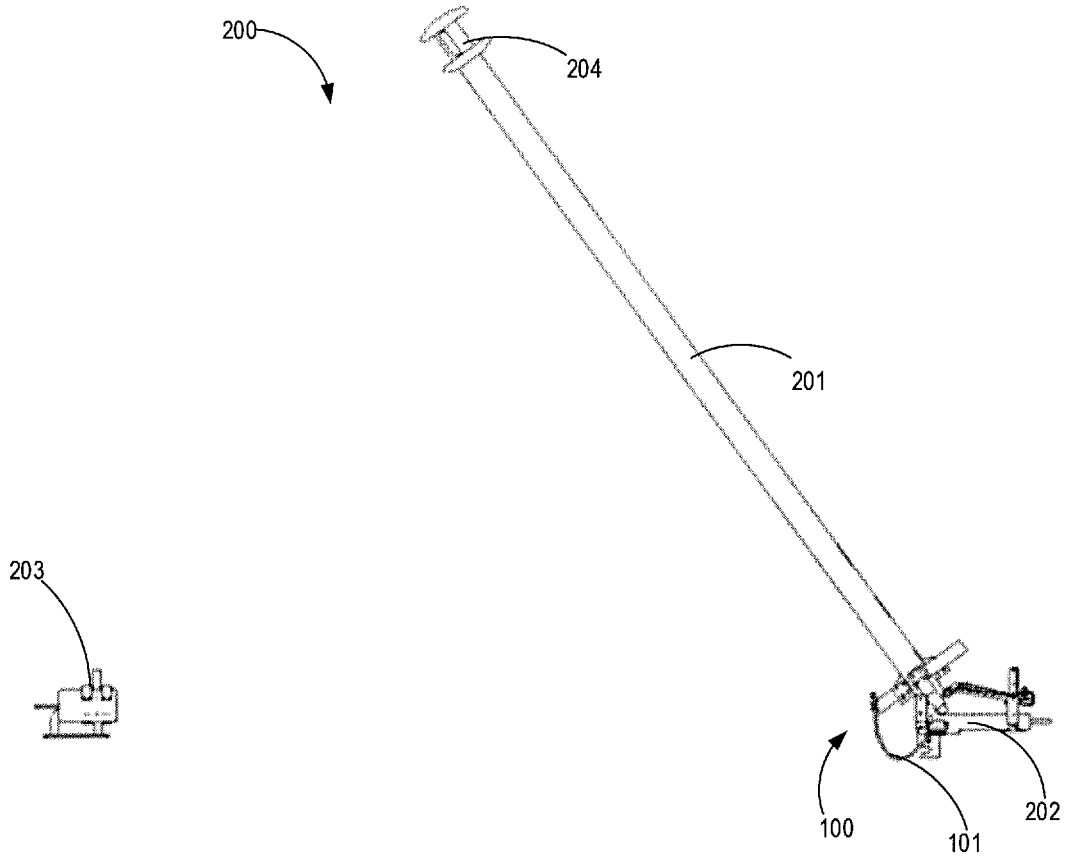
FIGS. 5A and 5B show schematic diagrams of disconnection and connection of a disconnector using the flexible conductor according to embodiments of the present disclosure.
Figure 5B:
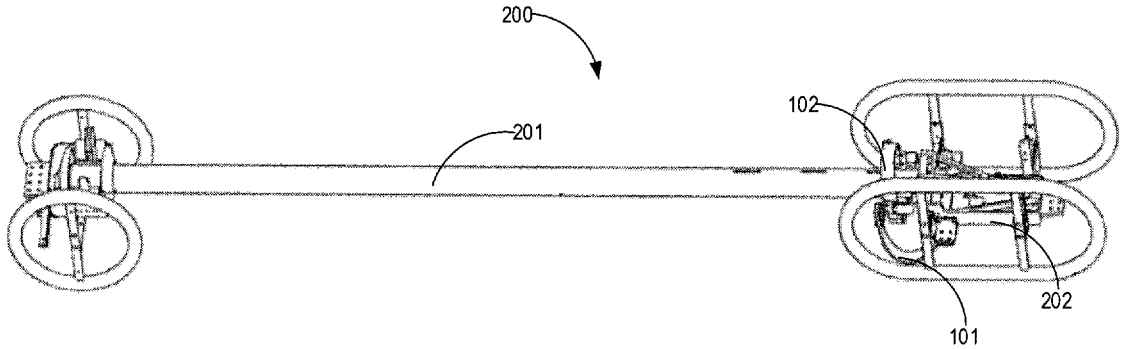

FIG. 2 shows a partial enlarged view of the main blade 201 and the base 202 with a flexible conductor 100 and FIG. 3 shows a perspective view of the flexible conductor 100 according to embodiments of the present disclosure attached to the main blade 201. FIGS. 4A-4C show a schematic diagram of the movement of the main blade relative to the base and FIGS. 5A and 5B show schematic diagrams of disconnection and connection of a disconnector using the flexible conductor according to embodiments of the present disclosure.

As shown, according to embodiments of the present disclosure, the flexible conductor 100 comprises a first portion 101 and a second portion 102 connected to each other. The first portion 101 is fixed to the base 202 and the second portion 102 is fixed to the main blade 201. In order to open or close the disconnector 200, the main blade 201 must necessarily rotate and twist with respect to the base 202.

When the main blade 201 rotates about an axis (referred to as "first axis") X1, the first portion 101 can bend in a plane (referred to as "first plan" for ease of discussion) P1. Similarly, when the main blade 201 twists about an axis (referred to as "second axis" for ease of discussion) X2, the second portion 102 can bend in a plane (referred to as "second plan" for ease of discussion) P2. The first plane P1 and the second plane P2 are substantially perpendicular to each other. In this way, the flexible conductor 100 can maintain an electrical connection between the main blade 201 and the base 202 steadily and durably when opening or closing the disconnector 200.

Contrary to the conventional conductor between the main blade 201' and the base 202', the flexible conductor 100 according to embodiments of the present disclosure can provide steady electrical connection between the main blade 201 and the base 202 without the extra contacts. The cost and the risk of heat dissipation are thus minimized. The friction between the extra contacts thus does not exist at all, the power for driving the main blade to rotate and twist is reduced. Furthermore, the first and second portions 101, 102 can bend in respective plane, and do not interfere with each other. Thus, the stability of the flexible conductor 100 is improved.

The first plane P1 and the second plane P2 are not necessarily needed to be exactly perpendicular to each other. Rather the first plane P1 can be substantially perpendicular to the second plane P2. Herein "substantially perpendicular" means the angle between the first and second plane P1, P2 can vary between 90°±20°. Only by way of example, in the case that the angle between the first and second plane P1, P2 is about 80°, the main blade 201 may also rotate and twist flexibly with respect to the base 202. This reduces the difficulty of assembling the flexible conductors 100.

Figure 6A:
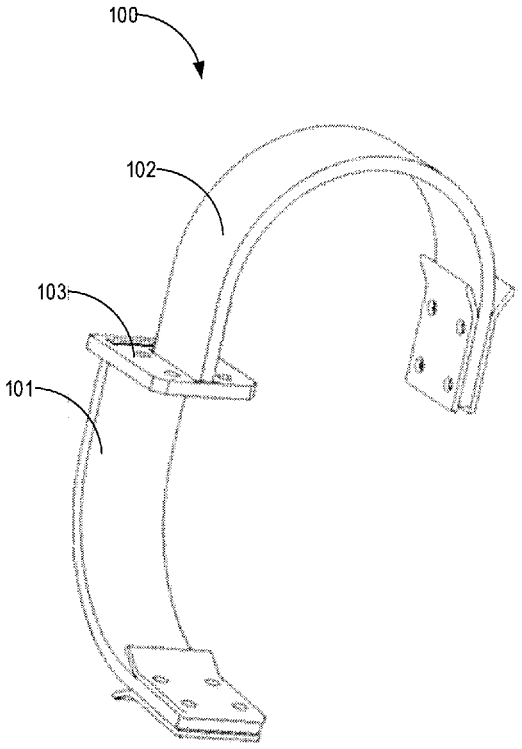
FIGS. 6A-6D show perspective views of the flexible conductors according to embodiments of the present disclosure attached to the main blade.

FIGS. 6A-6D show several ways for forming the flexible conductors 100 according to embodiments of the present disclosure. As shown in FIG. 6A, the first and second portions 101, 102 are connected to each other by welding on a mounting plate 103. The mounting plate 103 may have two slots substantially perpendicular to each other. Each of the slots may receive respective portion of the first and second portions 101, 102. As a result, the flexible conductor 100 may be formed in such a way that the first portion 101 and the second portion 102 are interchangeable, which will be discussed further below.

Figure 6B:
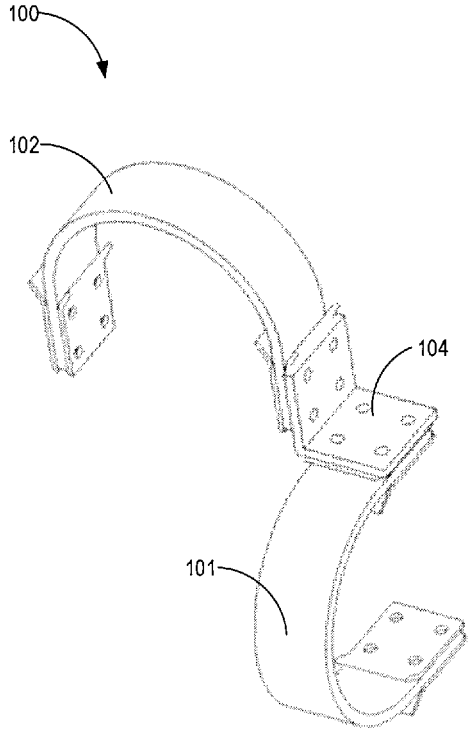

FIG. 6B shows the flexible conductor 100 that is formed with at least one fastener 104. Each fastener 104 may have mounting surfaces substantially perpendicular to each other. The first and second portions 101, 102 may mounted on the respective mounting surface by any suitable manners, for example, by welding, bolts or screws. In this way, the flexible conductor 100 may be formed. Similar to the embodiments as shown in FIG. 6A, the first portion 101 and the second portion 102 may be interchanged in this case to improve the flexibility of assembling the flexible conductors 100.

Figure 6C:
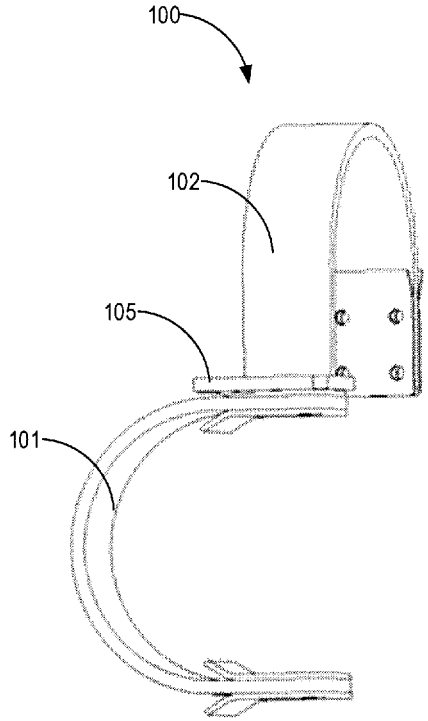

In some embodiments, the first and second portions 101, 102 may be connected by a single plate 105 in different ways. For example, the first portion 101 may be fixed to the plate 105 using screws or bolts and the second portion 102 may be fixed to the plate 105 by welding, as shown in FIG. 6C. In this way, the first and second portions 101, 102 may be connected to each other in more flexible ways.

Figure 6D:
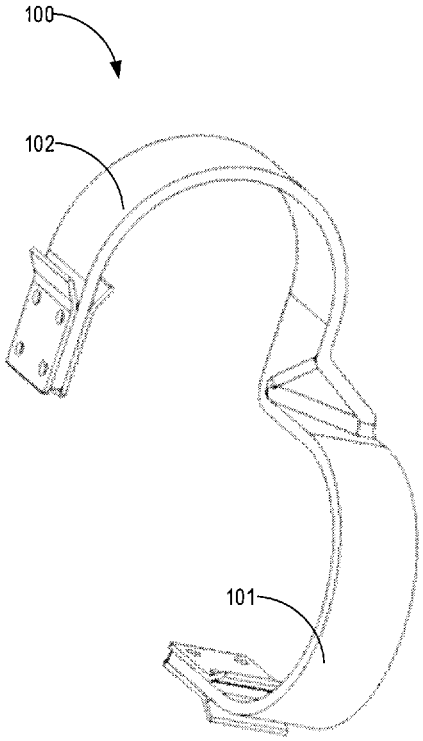

In some embodiments, the first and second portions 101, 102 may be integrally formed. For example, the flexible conductor 101 may be formed by deforming the middle part, i.e., the part between the first and second portions 101, 102, as shown in FIG. 6D. The middle part may be deformed by any suitable ways, for example, by pressing, punching, stamping or the like. In this way, the flexible conductor 100 may be mounted on the main blade and the base more easily and not be easily damaged.

As mentioned above, in some embodiments, the first and second portions 101, 102 are interchangeable. Specifically, as to the integrally formed flexible conductor 101, the interchangeable first and second portions 101, 102 means that one end of the flexible conductor 101 may be fixed to any of the main blade 201 and the base 202 and another end fixed to the remaining. This reduces the complexity of the assembly. On the other hand, as to the first and second portions 101, 102 being separately formed, the first and second portions 101, 102 may be a same portion. That is, the flexible conductor 101 may be formed by assembling two same portions. Furthermore, the two ends of the separately formed flexible conductor 101 may also be interchangeably fixed to the main blade 201 and the base 202. Consequently, this interchangeable arrangement of the first and second portions 101, 102 increases the flexibility of assembly and mounting the flexible conductor 101.

It is to be understood that the above implementation of forming the flexible conductor 100 is merely for illustration, without suggesting any limitations as to the scope of the present disclosure. Any other suitable methods are possible as well. For example, the flexible conductor 100 may be formed by snapping or adhesively connecting the first and second portions 101, 102.

In some embodiments, at least one of the first and second portions 101, 102 may be of substantial C-shape to further improving the flexibility when bending. The sections of C-shaped structures of the first and second portions 101, 102 may be substantially perpendicular to each other. The C-shaped structures of the first and second portions 101, 102 may cause the first and second portions 101 to be bent for a long time without breaking or damaging, thereby extending the service life of the first and second portions 101, 102.

It is to be understood that the above implementation of the first and second portions being of substantial C-shape or U-shape is merely for illustration, without suggesting any limitations as to the scope of the present disclosure. Any other suitable methods are possible as well. For example, at least one of the first and second portions 101, 102 may have a U-shaped structure.

At least one of the first and second portions 101, 102 may comprise multiple layers of metal sheets in some embodiments. That is, the first and the second portions 101, 102 may be formed by stacking multiple layers of metal sheets. In order to meet the requirement of an Rated short-time withstand current (ICW) of the disconnector 200, a sectional area of the multiple layers of the metal sheets is at least greater than an area required by ICW. As a result, the flexible conductor 100 may conduct the current in the main circuit of the disconnector 200.

In some embodiments, the metal sheets may be laminated at two ends of the flexible conductor 100 or at two ends of at least one of the first and second portions 101, 102. For example, in the case where the first and second portions 101, 102 are formed integrally, the flexible conductors 100 may be formed by laminating the metal sheets at two ends. Alternatively, in the case where the first and second portions 101, 102 are connected by welding or at least one fastener as mentioned above, each of the first and second portions 101, 102 may be formed by laminating the metal sheets at two ends of the respective portion.

The two ends of the first and second portions 101, 102 or the flexible conductors 100 may be laminated by welding the multiple layers of the metal sheets together. In some embodiments, the two ends may be laminated by two plates. For example, the two plates may laminate the metal sheets by using the bolts or screws to reduce a distance between the two plates. It is to be understood that the above implementation of laminating the two ends of the flexible conductor 100 is merely for illustration, without suggesting any limitations as to the scope of the present disclosure. Any other suitable methods are possible as well. For example, the two ends of the flexible conductor 100 may be laminated by clamping or any other suitable manners.

In some embodiments, the metal sheets may be made of copper or aluminum. By using aluminum as the metal sheets, the cost of the flexible conductor 100 may be further reduced. Furthermore, the aluminum sheets have higher ductility and thus increase the flexibility of the flexible conductor 100. It is to be understood that the above implementation of the material of the metal sheets is merely for illustration, without suggesting any limitations as to the scope of the present disclosure. Any suitable material is possible as well. For example, the metal sheets may also be made of iron or the like. In some embodiments, each of the metal sheets may be coated with silver to improve the conductivity of the flexible conductor 100.

It should be appreciated that the above detailed embodiments of the present disclosure are only to exemplify or explain principles of the present disclosure and not to limit the present disclosure. Therefore, any modifications, equivalent alternatives and improvement, etc. without departing from the spirit and scope of the present disclosure shall be comprised in the scope of protection of the present disclosure. Meanwhile, appended claims of the present disclosure aim to cover all the variations and modifications falling under the scope and boundary of the claims or equivalents of the scope and boundary.

What is claimed is:

1. A flexible conductor for connecting a main blade and a base of a disconnector, comprising a first portion and a second portion;

wherein the first portion is fixed to the base and adapted to bend in a first plane (P1) in response to a rotation of the main blade about a first axis (X1); and the second portion is connected to the first portion and fixed to the main blade, the second portion adapted to bend in a second plane (P2) substantially perpendicular to the first plane (P1) in response to twisting of the main blade about a second axis; (X1); and wherein the flexible conductor is operable to maintain an electrical connection between the main blade and the base when the main blade rotates and twists with respect to the base to open or close the disconnector.

2. The flexible conductor of claim 1, wherein at least one of the first and second portions comprises multiple layers of metal sheets.

3. The flexible conductor of claim 1, wherein the first and second portions are interchangeable.

4. The flexible conductor of claim 2, wherein a sectional area of the multiple layers of metal sheets is at least greater than an area required by an Rated short-time withstand current (ICW) of the disconnector.

5. The flexible conductor of claim 2, wherein the multiple layers of metal sheets are laminated at two ends of the flexible conductor.

6. The flexible conductor of claim 2, wherein the metal sheets are made of copper or aluminum.

7. The flexible conductor of claim 2, wherein each of the metal sheets is coated with silver.

8. The flexible conductor of claim 1, wherein the first and second portions are integrally formed.

9. The flexible conductor of claim 8, wherein the flexible conductor is formed by deforming a part between the first and second portions.

10. The flexible conductor of claim 1, wherein the first and second portions are connected to each other by at least one fastener or by welding.

11. The flexible conductor of claim 10, wherein the at least one fastener comprises mounting surfaces perpendicular to each other.

12. The flexible conductor of claim 1, wherein at least one of the first and second portions is substantially C-shaped or U-shaped.

13. The flexible conductor of claim 12, wherein sections of C-shaped or U-shaped structures of the first and second portions are substantially perpendicular to each other.

14. A disconnector comprising a main blade and a base connected to each other using the flexible conductor of claim 1.

* * * * *